US007211059B2

(12) United States Patent
Takashima

(10) Patent No.: US 7,211,059 B2
(45) Date of Patent: May 1, 2007

(54) HEMORRHOID TREATMENT DEVICE

(76) Inventor: Jiro Takashima, 7203 Schiller, Houston, TX (US) 77055

( * ) Notice: Subject to any disclaimer, the term of this patent is extended or adjusted under 35 U.S.C. 154(b) by 0 days.

(21) Appl. No.: 11/121,679

(22) Filed: May 4, 2005

(65) Prior Publication Data

US 2005/0203449 A1 Sep. 15, 2005

Related U.S. Application Data

(63) Continuation-in-part of application No. 10/740,248, filed on Dec. 19, 2003, now abandoned, which is a continuation-in-part of application No. 09/883,900, filed on Jun. 19, 2001, now Pat. No. 6,589,193, which is a continuation-in-part of application No. 09/675,436, filed on Sep. 29, 2000, now Pat. No. 6,802,850.

(51) Int. Cl.
*A61H 21/00* (2006.01)

(52) U.S. Cl. ..... 601/137; 601/135; 606/197

(58) Field of Classification Search ..... 601/18, 601/45, 134, 135, 137; 606/191, 197, 198; 604/12, 15, 514; 600/38, 39, 40, 41; 482/148, 482/105; D24/119, 135, 215
See application file for complete search history.

(56) References Cited

U.S. PATENT DOCUMENTS

D143,924 S * 2/1946 McFadden ..... D24/135
2,478,786 A 8/1949 Smallen
2,721,549 A * 10/1955 Ferraro ..... 128/98.1
2,763,265 A 9/1956 Waters
3,675,642 A 7/1972 Lord
3,916,906 A 11/1975 Gerry
4,542,753 A 9/1985 Brenman et al.
5,404,881 A 4/1995 Cathaud et al.
D384,412 S * 9/1997 Mainiero ..... D24/135
5,797,950 A 8/1998 Takashima
5,861,009 A 1/1999 Takashima
D428,488 S 7/2000 Bloch
6,589,193 B2 7/2003 Takashima

* cited by examiner

*Primary Examiner*—Quang D. Thanh
(74) *Attorney, Agent, or Firm*—Egbert Law Offices

(57) ABSTRACT

A hemorrhoid massage device has a unitary body with a first end and a second end. The first end has a size suitable for fitting into a human rectum. The body has a middle section and a concave section. Each of the middle section and the concave section has a length of between 12 mm and 20 mm. The ends of the concave section and the middle section have approximately equal diameters. These diameters are less than one-half the total length of the middle section and the concave section.

2 Claims, 1 Drawing Sheet

HEMORRHOID TREATMENT DEVICE

RELATED U.S. APPLICATIONS

The present application is a continuation-in-part of U.S. patent application Ser. No. 10/740,248, filed on Dec. 19, 2003, and entitled "Hemorrhoid Treatment Device", now abandoned. U.S. patent application Ser. No. 10/740,248 is a continuation-in-part of U.S. patent application Ser. No. 09/883,900, filed on Jun. 19, 2001, and entitled "Hemorrhoid Treatment and Prostate Massage Apparatus", issued on Jul. 8, 2003 as U.S. Pat. No. 6,589,193. U.S. patent application Ser. No. 09/883,900 was a continuation-in-part of U.S. patent application Ser. No. 09/675,436, filed on Sep. 29, 2000, and entitled "Prostate Massage Apparatus" issued as U.S. Pat. No. 6,802,850 on Oct. 12, 2004.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to apparatus for the treatment of hemorrhoids. More particularly, the present invention relates to devices for massaging internal and external hemorrhoids by the self-movement of the device. The present invention also relates to devices that are held within the anal canal and are driven by the peristaltic activity of the surface of the anal canal for the purpose of massaging internal and external hemorrhoids.

BACKGROUND OF THE INVENTION

One treatment for non-bacterial disorders of the prostate such as chronic prostatitis and a congested prostate is the prostate massage. Some urologists believe that the most effective treatment for such prostatitis is for the doctor to massage the prostate at regular intervals. Other urologists are far less enthusiastic about this procedure, and some do not believe in it at all. To perform such a massage, the physician simply inserts a gloved finger into the rectum and strokes the prostate very gently. It serves to relieve the symptoms of chronic prostatitis by draining accumulated prostatic fluid from the glands and ducts.

Given the difference of opinion of urologists as to the need for prostatic massages, such massages can be difficult to obtain. In any event, the regular and repeated massaging of the prostate can often require frequent visits to the doctor's office. This causes the patient to incur a considerable expense and inconvenience. As such, a need has developed for allowing an individual to carry out his own prostatic massage.

Hemorrhoids can be of severe pain to the individual. In may circumstances, external medicines are applied to the hemorrhoid for the treatment of such hemorrhoidal tissues. However, the external application of such medicines is only moderately effective in the treatment and remedying of severe hemorrhoidal conditions. It is believed that a hemorrhoid massage is most effective in stimulating blood flow in the area of the hemorrhoidal tissues. Heretofore, no device has been developed which effectively stimulates blood flow in such area.

In the past, some patents have issued relating to rectal devices. U.S. Pat. No. 4,542,753, issued on Sep. 24, 1985 to Brenman et al., describes an apparatus and method for stimulating penile erectile tissue. In this invention, a body is provided which may be inserted into the rectum of a user. The body is shaped so as to closely conform to the topological configuration of the rectum within the anal area to a site adjacent to the prostate gland. Electrical circuitry for generating a neurally stimulating electrical signal is located within the body. Electrodes, placed at particular locations on the surface of the body, apply the signal to the user. At least one of the electrodes closely contacts the prostate gland when the body member is operatively disposed, at a region or spot on the prostate gland previously determined to be sensitive to electrical stimulation.

U.S. Pat. No. 5,404,881, issued on Apr. 11, 1995 to Cathaud et al., describes a trans-rectal probe. This trans-rectal probe includes a probe body made of a flexible self-supporting polymer material whose degree of flexibility is designed to enable it to comply with the shape of the rectum while having substantially no compression effect on the rectum when inserted therein. The invention makes it possible to achieve accurate, safe and reliable positioning of an instrument for detection or therapeutic treatment level with the organ to be observed or treated. In particular, this device is designed for treatment of the prostate.

U.S. Pat. No. 2,478,786, issued on Aug. 9, 1949 to H. M. Smallen, describes a prostate gland massaging implement. This implement includes a lever having an interior handle which constitutes a power arm to extend down in front of the abdomen and a substantially horizontal portion extending under the groin and offset laterally to avoid the genital organs. The implement has an upwardly and forwardly bent posterior portion which forms the work arm. This work arm extends into the rectal passage to bear across the frontal wall thereon adjacent the prostate gland. The bent portion between the horizontal and the posterior portions serves as a fulcrum point against the front wall of the rectal opening when the implement is subject to pivotal movement around this point.

The present inventor has two United States patents showing devices for releasing congested prostate fluid. U.S. Pat. No. 5,797,950, issued on Aug. 25, 1998, describes such a device including a head having a size suitable for fitting in a human rectum and through a sphincter. The head has a size suitable for rubbing the prostate gland. A rod is connected to the bottom of the head and extends outwardly therefrom. The rod serves to position the head and guide a movement of the head as the sphincter contracts and relaxes. An abutment surface is affixed to the rod distal the head. The abutment surface contacts the perineum area and pushes up on the perineum area as the sphincter contracts. The rod is a rigid rod having a generally L-shaped or Comprising:-shaped configuration with a radius of curvature such that the head tilts toward the prostate gland as the sphincter contracts and draws the head upwardly. The head has a generally ellipsoidal shape.

U.S. Pat. No. 5,861,009, issued on Jan. 19, 1999 to the present inventor, describes an apparatus for releasing congested prostate fluid having a head with a size suitable for fitting into a human rectum and through the sphincter and having a surface for pushing on the prostate gland. A rod is connected to the bottom of the head and extends outwardly therefrom so as to guide a movement of the head as the sphincter relaxes and contracts. An abutment member is positioned on the rod opposite the head so as to push on the perineum area simultaneously with the head pushing on the prostate gland. The abutment member has a variable angular relationship with the head.

In each of these prior art patents to the present inventor, the rod movably holds the head within the sphincter, and when the external sphincter contracts, the lateral pressure of the external sphincter drives the head upwardly and the rod adds pressure against the perineum area simultaneously. The power of the sphincter's contraction is divided into one for pressure on the prostate and one for pressure onto the perineum area. Under certain circumstances, some persons have felt that the perineum pressure by this rod was strong and uncomfortable.

There are several anal treatment dialators and other mechanical devices that are intended to be received within various human body orifices. For example, U.S. Pat. No. 3,675,642, issued on Jul. 11, 1942, is a stationary device having greater than one inch diameter. The diameters of a narrow section and a middle section of the device are more than two times the length of the narrow and middle section. The device has a proportionately large diameter, in comparison with the length of the device, and induces an evacuative response of the anorectal area. Also, the diameter of the first section of the device is smaller than the middle section of the device. This large area of narrowing tapered surface toward the top end of the device receives an outward thrust force from an lateral pressure of the anorectal area.

U.S. Pat. Nos. 2,763,265 and 3,916,906 are devices that each has a middle section with very small ends in comparison with the first and second ends of the concave section and a proportionately large diameter at the first end of the narrow section compared to the length of the middle section. The diameters of the middle section and the narrow section are not equal. Since both devices have smaller diameters at the ends sections with larger diameters in the middle sections, the device is very difficult to retain within the anal canal.

U.S. Design Pat. No. 428,488 shows the design of a device having a very large diameter in comparison with the length of the middle section. The device also includes large spherical objects at the first end and the second end thereof. As such, the device makes it very difficult to initiate peristaltic movement within anal canal.

U.S. Pat. No. 6,589,193, to the present inventor, utilizes balance for the purpose of retaining the device within the anal canal. The balanced position is the result of the tapered surfaces at the head and at the resistor.

It is an object of the present invention to neutrally hold the device within the anal canal by the pecten and induce peristaltic movement of the anal canal. As such, the device can be driven slightly backward and forward by the peristaltic activity within the anal canal.

It is another object of the present invention to utilize the slight movements of the device as caused by peristaltic movement to effectively massage the internal and external hemorrhoids without aggravating the hemorrhoidal condition.

It is still a further object of the present invention to provide a device which utilizes the peristaltic movement within the pecten to consume a large amount of energy in order to increase fresh blood circulation in the anorectal area in order to improve hemorrhoidal conditions.

It is still a further object of the present invention to provide a small diameter device having smooth curved surfaces so as to avoid further aggravating the conditions of the hemorrhoids.

It is another object of the present invention to provide a hemorrhoid treatment device which is easy to use, inexpensive, and easy to manufacture.

These and other objects and advantages of the present invention will become apparent from a reading of the attached specification and appended claims.

BRIEF SUMMARY OF THE INVENTION

The present invention is a device a hemorrhoid massage device that comprises a unitary body having a first end and a second end. The first end has a size suitable for fitting into a human rectum. The unitary body has a first surface extending from the first end to an end of a middle section thereof. The middle section extends from the first surface to a first end of a concave section. The concave section has a concavity formed therein. The middle section has a length of between 12 mm and 20 mm inclusive. The concave section has a length of between 12 mm and 20 mm inclusive. The concave section has a first end on an opposite side of the concavity from the first end of the concave section. The first and second ends of the concave section and the end of the middle section have approximately equal diameters. Optimally, each of these diameters is less then one-half a total length of the middle section and the concave section.

In one embodiment of the present invention, the first surface is a straight cylindrical surface. The middle section has a straight cylindrical surface extending from the end thereof to the first end of the concave section. The middle section will have a maximum diameter that is equal to a maximum diameter of the first surface. In another embodiment of the present invention, the first end has a bulbous portion formed thereat. The first surface is a tapered surface that narrows in diameter and extends from the bulbous portion to an end of the middle section. In one form of this embodiment, the middle section has a convex surface extending from the end thereof to the first end of the concave section. In another form of this embodiment, the middle section has a concave surface extending from the end thereof to the first end of the concave section.

DETAILED DESCRIPTION OF THE INVENTION

Figure 1:
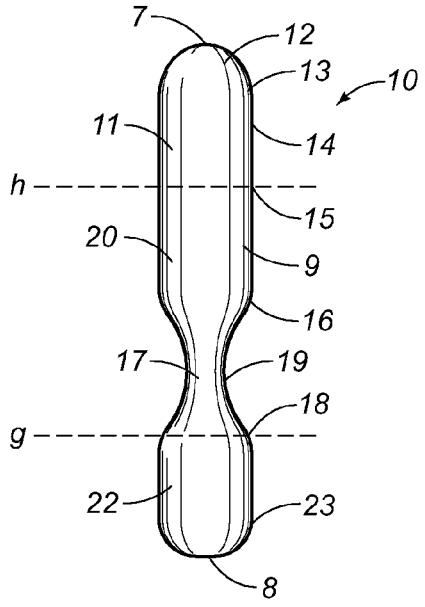
FIG. 1 is a side elevational view of a preferred embodiment of the hemorrhoidal treatment device of the present invention.

Referring to FIG. 1, there is shown the hemorrhoid treatment device 10 in accordance with the preferred embodiment of the present invention. The hemorrhoid treatment device 10 is particularly configured so as to work with the pecten of the anal canal. This pecten is a narrow concave section of the anal canal.

The device 10 has a first end 7 and a second end 8. The device 10 has a unitary body 9 that extends between the first end 7 and the second end 8. In particular, this unitary body 9 has a first end section 11, a middle section 20 and a concave section 17. The first end 11 extends between the end 7 of the body 9 and an end 15 of the middle section 20. The end 15 of the middle section 20 is designated with the broken line "h". The middle section 20 is located between the end 15 and the first end 16 of the concave section 17. The concave section 17 is located between the first end 16 and a second end 18. This second end 18 of the concave section 17 is illustrated by the broken line "g". As can be seen, a concavity 19 is formed in the concave section 17 between the ends 16 and 18 thereof.

The first end section 11 has a curved surface 12 adjacent to the end 7. The curved surface 12 extends from end 7 in a direction toward the middle section 20. This curved surface 12 is suitable for fitting into a human rectum. The curved surface terminates in an area 13 of the first end section 11. A straight cylindrical surface 14 extends from the area 13 toward the end 15 of the middle section 20 and to the first end 16 of the concave section 17. The concave section 17 is illustrated as having a concavity 19 formed between the first end 16 and the second end 18 thereof. In practice, the device can be terminated adjacent to the second end 18 thereof. There is a tail 22 that extends toward the second end 8. A curved surface 23 is formed at the end of tail 22 adjacent to the end 8. Tail 22 can include various kinds of auxiliary attachments. The tail 22 can have a cylindrical or slightly widening curved surface toward the end 23. This tail can be used as a handle. The arrangement of this handle will not disturb free movement of the device 10 by friction with skin on both sides of the anus. The preferred length of the device 10 as extending from the area 13 to the end 18 of the concave section 17 is 40 mm to 100 mm.

The distance between the broken line "h" at the end 15 of the middle section 20 and the broken line "g" at the end 18 of the concave section 17 is between 26 mm and 40 mm inclusive. This distance represents an entire length of the human anal sphincter. The length of the middle section 20 is between 12 mm and 20 mm. This distance represents the length of the internal hemorrhoidal area. The length of the concave section 17 is between 12 mm and 20 mm. This distance represents the total length of the pecten and the external sphincter. The preferred length from the area 13 of the first section 11 and the end 15 of the middle section is no less than the length of the middle section 20. This area works as a buffer or stabilizer zone of the device 10 to avoid slipping out of the anal canal. The length of the middle section 20 and the length of the concave section 17 are approximately equal. The diameter of the end 15 of the middle section 20 and the first end 16 and the second end 18 of the concave section 17 are approximately equal. Optimally, these diameters are less than half of the entire length of the human anal sphincters. The maximum diameter of the middle section 20 and the first end 11 are equal.

Figure 2:
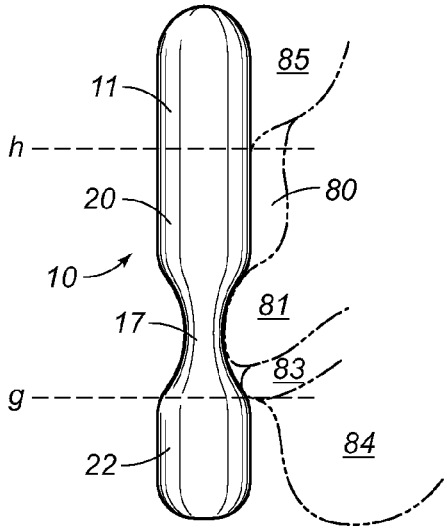
FIG. 2 is an illustration of a preferred embodiment of the hemorrhoidal treatment device of the present invention as located within the pecten in the anal canal.

FIG. 2 shows the relationship between the hemorrhoid treatment device 10 and the components of the anal canal. The main components of the anal canal are the internal hemorrhoidal area 80, the pecten 81 and the subcutaneous external sphincter 83. The subcutaneous external sphincter 83 contains the external hemorrhoid 84 in the side skin of the anus. Above the internal hemorrhoidal area 80 is the ampulla of the rectum 85. When the device 10 in use, it is inserted into the anal canal as the concave section 17 is grabbed by the pecten 81 and the external sphincter 83. The length of the concave section 17 of the device 10 is between 12 mm and 20 mm in order to fit the length of the pecten 81 and the external sphincter 83.

The pecten 81 spans more than the middle third of the anal canal. The pecten 81 will have a length of about 10 mm to 15 mm. The pecten 81 is characterized by the formation of a thick hardened ring of fibrous tissue with resulting stenosis contracture to form a narrow passage wall.

When the pecten 81 grips the concave section 17 of the device 10, the device 10 cannot move from the anal canal unless the evacuative pressure is added to the device. This is because the first end 16 and the second end 18 of the concave section 17 serves as a bulwark. As the peristaltic motion within the pecten 81 continues to try to remove the device 10 from the pecten 81, the device 10 slightly moves backward and forward for a short distance within the pecten 81. Additionally, since the diameter of the end 15 of the middle section 20 and the end 16 are equal, there will be no thrust force caused by the lateral pressure of the internal hemorrhoidal area to the middle section and, as a result, will not interfere with the gripping ability of the pecten 81.

The peristaltic movement of the pecten consumes a large amount of energy. This causes increased blood circulation and will cause an increased temperature in the hemorrhoidal area. As a result, the device will not only massage the hemorrhoids but will also cure the hemorrhoidal condition.

Figure 3:
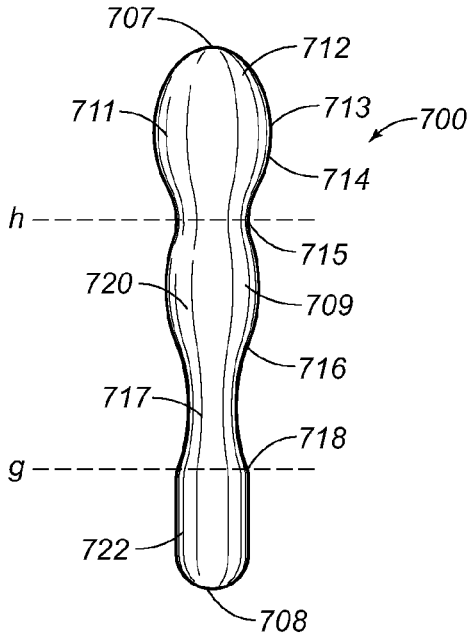
FIG. 3 is a side elevational view of a first alternative embodiment of the hemorrhoidal treatment device of the present invention.

FIG. 3 shows a first alternative embodiment of the hemorrhoid treatment device 700 of the present invention. The device 700 has a first end section 711, a middle section 720 and a concave section 717. The first end section 711 has first end 707 with a curved surface 712 extending therefrom to an area 713. A narrowing tapered surface 714 extends from the area 713 to an end 715 of the middle section 720. The end 715 of the middle section 720 is indicated by the broken line "h" in FIG. 3.

In FIG. 3, the middle section 720 is illustrated as extending in a convex manner between the end 715 and the first end 716 of the concave section 717. The concave section 717 is illustrated as extending in a concave manner between ends 716 and 718. The end 718 of the concave section 717 is illustrated by broken line "g". The tail 722 or handle is attached to the end 718 of the concave section 717. The length from the area 713 of the end section 711 to the end 718 of the concave section 717 is between 30 mm and 100 mm. The distance between the end 715 of the middle section 720 and the end 718 of the concave section 717 is between 26 mm and 40 mm inclusive. The length between the end 715 of the middle section 720 and the end 716 is between 12 mm and 20 mm inclusive. The length between the end 716 and the end 718 is between 12 mm and 20 mm inclusive. The diameters of the end 715 of the middle section 720 and the ends 716 and 718 of the concave section 717 are approximately equal. Optimally, these diameters can be between 6 mm and 19 mm inclusive.

In the alternative embodiment of the shown in FIG. 3, the end section 711 can have various shapes of surfaces extending from area 713 to the end 715 to the middle section 720. The maximum diameter of the middle section 720 is no more than a maximum diameter of the end section 711.

Figure 4:
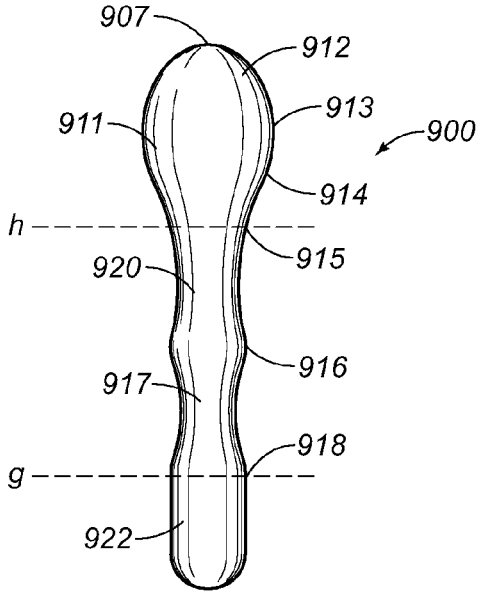
FIG. 4 is a side elevational view of second alternative embodiment of the hemorrhoidal treatment device of the present invention.

FIG. 4 shows a second alternative embodiment of the hemorrhoid treatment device 900 of the present invention. The device 900 has a first end section 911, a middle section 920 and a concave section 917. The first end section 911 has a first end 907 with a curved surface 912 extending therefrom to an area 913. The first end 907 has a bulbous upper portion with a size suitable for fitting into a human rectum. A narrowing tapered surface 914 extends from the area 913 to an end 915 of the middle section. This end 915 is indicated by the broken line "h". The middle section 920 is located between the end 915 and a first end 916 of the concave section 917. The middle section 920 has a concave surface extending between the end 915 and the first end 916 of the concave section 917. The concave section 917 a concavity extending from the first end 916 to a second end 918. This second end 918 is indicated by the broken line "g". As stated with the previous embodiments of the present invention, the device 900 can be terminated at the second end 918 of the concave section. However, it is preferable that a tail 922 be secured to the end 918 so as to provide an extension surface suitable for use as a handle. The preferred length from the first end section 907 to the second end 918 of concave section 917 is less than 100 mm.

The length from the broken line "h" and the broken line "g" is 26 mm to 40 mm inclusive. The length of the middle section is 12 mm to 20 mm inclusive. The length of the concave section is also 12 mm to 20 mm inclusive. The diameters of the end 915 and the end 916 and the end 918 are approximate equal. The length of these diameters are less than a half of the length of human anal canal. Optimal diameters are between 8 mm and 12 mm inclusive. The maximum diameter of the middle section 920 is no more than the maximum diameter of the first section 911.

Within the concept of the present invention, in order to properly be configured for receipt within the human anal canal, each of the optimal diameters of the ends of the middle section and the concave section are less than one-half a total length of the middle section and the concave section. As such, in contrast to prior art devices, the unitary body associated with each of the embodiments of the present invention is suitable for manipulation within the anal canal and suitable for manipulation by the pecten, along with the sphincter muscles. The device can be retained within the anal canal in a proper massaging manner.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A hemorrhoid massage device comprising: a unitary body having a first end and a second end, said first end having a size suitable for fitting into a human rectum, said unitary body having a first surface extending from said first end to an adjacent end of a middle section thereof, said first surface being of a straight cylindrical shape, said middle section having a straight cylindrical surface extending from said first surface to an adjacent first end of a concave section, said concave section having a continuously curved concavity extending from said first end of said concave section to a second end on an opposite side of said concavity, said middle section and said concave section having an equal length of between 12 millimeters to 20 millimeters inclusive, said first and second ends of said concave section and said adjacent end of said middle section having approximately equal diameters of between 6 mm and 12 mm inclusive.

2. The device of claim 1, said concave section having a length that is no greater than a combined length of said first surface and said middle section.

* * * * *